US010458379B2

(12) United States Patent
Thibault et al.

(10) Patent No.: US 10,458,379 B2
(45) Date of Patent: Oct. 29, 2019

(54) INJECTOR ARRANGEMENT

(71) Applicant: DELPHI TECHNOLOGIES IP LIMITED, St. Michael (BB)

(72) Inventors: Thierry Thibault, Saint Ouen les Vignes (FR); Cyrille Lesieur, Courbouzon (FR); Rodolphe Dratch, La Chasussee Saint Victor (FR)

(73) Assignee: DELPHI TECHNOLOGIES IP LIMITED (BB)

( * ) Notice: Subject to any disclaimer, the term of this patent is extended or adjusted under 35 U.S.C. 154(b) by 19 days.

(21) Appl. No.: 14/906,691

(22) PCT Filed: Jul. 16, 2014

(86) PCT No.: PCT/EP2014/065267
§ 371 (c)(1),
(2) Date: Jan. 21, 2016

(87) PCT Pub. No.: WO2015/010995
PCT Pub. Date: Jan. 29, 2015

(65) Prior Publication Data

US 2016/0160820 A1 Jun. 9, 2016

(30) Foreign Application Priority Data

Jul. 22, 2013 (EP) ..... 13177355

(51) Int. Cl.
*F02M 51/06* (2006.01)
*F02M 47/02* (2006.01)

(52) U.S. Cl.
CPC ..... *F02M 47/027* (2013.01); *F02M 51/0639* (2013.01); *F02M 51/0667* (2013.01)

(58) Field of Classification Search
CPC ..... F02M 47/027; F02M 51/0667; F02M 51/0639

(Continued)

(56) References Cited

U.S. PATENT DOCUMENTS 4,798,186 A * 1/1989 Ganser ..... F02M 47/027 123/446
4,946,103 A * 8/1990 Ganser ..... F02M 47/027 239/585.1

(Continued)

FOREIGN PATENT DOCUMENTS

DE 102010038556 A1 * 2/2012 ..... F02M 51/00
EP 2320061 A1 5/2011

(Continued)

OTHER PUBLICATIONS

Translation DE102010038556 A1.*
Search Report dated Sep. 18, 2014.
International Search Report dated Sep. 18, 2014.

*Primary Examiner* — Alexander M Valvis
*Assistant Examiner* — Qingzhang Zhou
(74) *Attorney, Agent, or Firm* — Joshua M. Haines

(57) ABSTRACT

A fuel injector includes an injector body with a bore; an injector needle located within the bore and engageable with a needle seat to control fuel injection through an injector outlet; an armature member, the armature member being engageable with an armature seat on the injector needle, the injector needle in part and the armature member in part defining a control chamber; an actuator arrangement arranged to control fuel pressure within the control chamber such that fuel pressure variations within the control chamber controls movement of the injector needle relative to the needle seat wherein the actuator arrangement is arranged to be capable of moving the armature member from a seated position in which it engages the armature seat to an unseated position in which the armature member has moved relative to the armature seat in order to bring the control chamber into fluid communication with a low pressure drain.

17 Claims, 9 Drawing Sheets

(58) Field of Classification Search
USPC ..... 239/88, 90, 91, 95, 96, 99, 124, 533.1, 239/533.2, 533.3, 533.4, 533.5, 533.8, 239/533.9, 585.1, 585.2, 5, 33.8
See application file for complete search history.

(56) References Cited

U.S. PATENT DOCUMENTS

| | | | | |
|---|---|---|---|---|
| 5,860,597 | A * | 1/1999 | Tarr | F02M 45/12 239/124 |
| 6,092,737 | A * | 7/2000 | Bosch | F02M 47/027 239/88 |
| 6,499,467 | B1 * | 12/2002 | Morris | F02M 47/027 123/446 |
| 6,793,161 | B1 * | 9/2004 | Fujita | F02M 47/02 239/533.2 |
| 8,925,524 | B2 | 1/2015 | Cooke | |
| 2003/0197067 | A1 | 10/2003 | Cowden | |
| 2007/0215717 | A1 | 9/2007 | Cooke | |

FOREIGN PATENT DOCUMENTS

| | | | |
|---|---|---|---|
| EP | 2562410 | A1 | 2/2013 |
| GB | 2341893 | A1 | 3/2000 |
| WO | 2013026611 | A1 | 2/2013 |

* cited by examiner

INJECTOR ARRANGEMENT

CROSS REFERENCE TO RELATED APPLICATIONS

This application is a national stage application under 35 USC 371 of PCT Application No. PCT/EP2014/065267 having an international filing date of Jul. 16, 2014, which is designated in the United States and which claimed the benefit of EP Patent Application No. 13177355.8 filed on Jul. 22, 2013, the entire disclosures each are hereby incorporated by reference in their entirety.

FIELD OF THE INVENTION

The present invention relates to an injector arrangement. In particular, the present invention relates to a fuel injector for use in an internal combustion engine.

BACKGROUND TO THE INVENTION

The present invention relates to a fuel injector used in the delivery of fuel to a cylinder of a diesel internal combustion engine of the type in which fuel is supplied to a high pressure accumulator (the "common rail") by a suitable pump and is delivered from the accumulator to the fuel injectors of the engine, the nozzles of which are arranged to actuate in turn to deliver fuel to the respective cylinders of the engine.

Such fuel injectors generally comprise a needle which is slidable within a body and engageable with a needle valve seat to control the flow of fuel from a high pressure fuel supply line through the body.

The maximum injection pressures within a fuel injector may be of the order of 1800 bar or higher and as a consequence the forces to be overcome in order to lift the needle of the injector are large. It is not therefore possible to directly control the injector using an electromagnetic actuator unless very high currents are used. The injector is therefore indirectly controlled by means of a valve arrangement which controls the pressurising or discharging of a control chamber located above the injector needle.

An example of such an injector is disclosed in EP0647780 in which the end of the needle remote from the valve seat extends within a chamber, the chamber being arranged to receive fuel from the supply line through a restrictor. In use, injection is controlled by varying the pressure within the control chamber. A solenoid actuator acts upon a valve arrangement to cause a flow path between the control chamber and a low pressure drain to open. As the pressure falls within the control chamber the needle leaves the needle valve seat due to pressure acting against a portion of the needle adjacent the valve seat.

Within common rail injection systems two types of valve arrangements are known, pressure-balanced valve arrangements (sometimes referred to as equilibrium valves) and non-pressure balanced valve arrangements.

In a pressure balanced valve arrangement a valve stem located within a bore is slidable under the action of the electromagnetic actuator to open and close a flow path between the high pressure region of the control chamber and the low pressure region of a low pressure drain. In the closed configuration the valve arrangement is in contact with a valve seat and is substantially in hydraulic equilibrium, with the valve arrangement being held in the closed position by the action of a spring on the valve arrangement. Upon actuating the electromagnetic actuator the spring force is overcome and the valve arrangement moves away from its seat thereby allowing fuel to move between the stem and bore to the low pressure drain. Equilibrium based valve arrangements tend to demonstrate a degree of static leakage. In other words, even in the closed position high pressure fuel will leak along the flow path defined between the bore of the valve arrangement and the valve stem to the low pressure drain.

In a non-pressure balanced valve arrangement the valve is held in its seated and closed position by the pressure of the high pressure fuel within the system. Such a valve arrangement is not therefore substantially in hydraulic equilibrium in the closed position and consequently requires a greater activation force in order to open. However, the degree of static leakage within such a non-pressure balanced valve arrangement is lower than in the pressure balanced valve arrangement.

The two types of valve arrangement described above therefore either have a low actuation force requirement with a relatively high degree of static leakage (pressure balanced valve arrangement) or high actuation force requirement with a relatively low degree of static leakage (non-pressure balanced valve arrangement).

It is an object of the present invention to provide an improved injector arrangement that has a low actuation force requirement but which has improved static leakage performance by acting directly on the needle.

Statements of Invention

According to a first aspect of the present invention there is provided a fuel injector for use in an internal combustion engine, the fuel injector comprising: an injector body comprising a bore; an injector needle located within the bore and engageable with a needle seat to control fuel injection through an injector outlet ; an armature member, the armature member being engageable with an armature seat on the injector needle, the injector needle in part and the armature member in part defining a control chamber; an actuator arrangement arranged to control fuel pressure within the control chamber such that fuel pressure variations within the control chamber controls movement of the injector needle relative to the needle seat wherein the actuator arrangement is arranged to be capable of moving the armature member from a seated position in which it engages the armature seat to an unseated position in which the armature member has moved relative to the armature seat in order to bring the control chamber into fluid communication with a low pressure drain.

The present invention provides a fuel injector in which the injector needle lift and injector needle opening and closing action is directly controlled by the movement of an armature which is in turn driven by an actuator arrangement.

Known injectors are managed via a sequence of events such as opening or closing of a control valve (which involves the build of a magnetic force over a time period before a spring force can be overcome); the release (or build) of pressure between a spill orifice and a valve seat within the control valve; release (or build) of pressure within a needle control chamber through a fixed inlet in order to create an unbalanced pressure force on the needle; and, movement of the injector needle in response to the unbalanced force.

By contrast, according to an injector of the present invention the movement of the injector needle is controlled by the position of an armature member that is in direct contact with the top of the injector needle. The present invention removes the need for or at least substantially avoids the need for spill control orifices or nozzle path orifices within the injector body. An injector according to an embodiment of the present invention may operate faster than known injector arrangements and may provide more efficient operation, particularly in multi-injection modes.

Conveniently, the bore within the injector body may comprise an annular gallery. The gallery may be in fluid communication with an accumulator volume via a high pressure drilling. The injector needle may comprise an axial drilling and the axial drilling may be in fluid communication with a source of high pressure fuel at a first end and in fluid communication with the control chamber at a second end.

Conveniently, the axial drilling may comprise a control chamber filling orifice to control the flow of fuel from the source of high pressure fuel into the control chamber.

The axial drilling may be in fluid communication with an annular gallery within the bore of the injector body, the gallery being in fluid communication with an accumulator volume via a high pressure drilling.

The injector may further comprise an armature spring member arranged to bias the armature member towards the armature seat. The injector may also further comprise an injector needle spring member arranged to bias the injector needle towards the valve seat.

The armature seat may be located at one end of the injector needle and conveniently the end of the injector needle comprising the armature seat may be substantially frustoconical defining a injector needle end profile, the armature seat being located on the end profile. The end of the injector needle comprising the armature seat may comprise more than one end profile.

Conveniently, a second end of the injector needle may be arranged to engage the valve seat.

Preferably, the actuator arrangement may be arranged to move the armature member from the seated position in which it engages the armature seat to a pilot injection to the low pressure drain being greater in the main injection position than the pilot injection position.

In a specific embodiment, the actuator arrangement is arranged on the extremity of the injector opposite to the injector outlet. This enables to arrange an internal reservoir of over 10 $cm^3$ able to withstand high pressure fuel.

BRIEF DESCRIPTION OF THE DRAWINGS

In order that the invention may be more readily understood, reference will now be made, by way of example, to the accompanying drawings in which.

DETAILED DESCRIPTION

Figure 1:
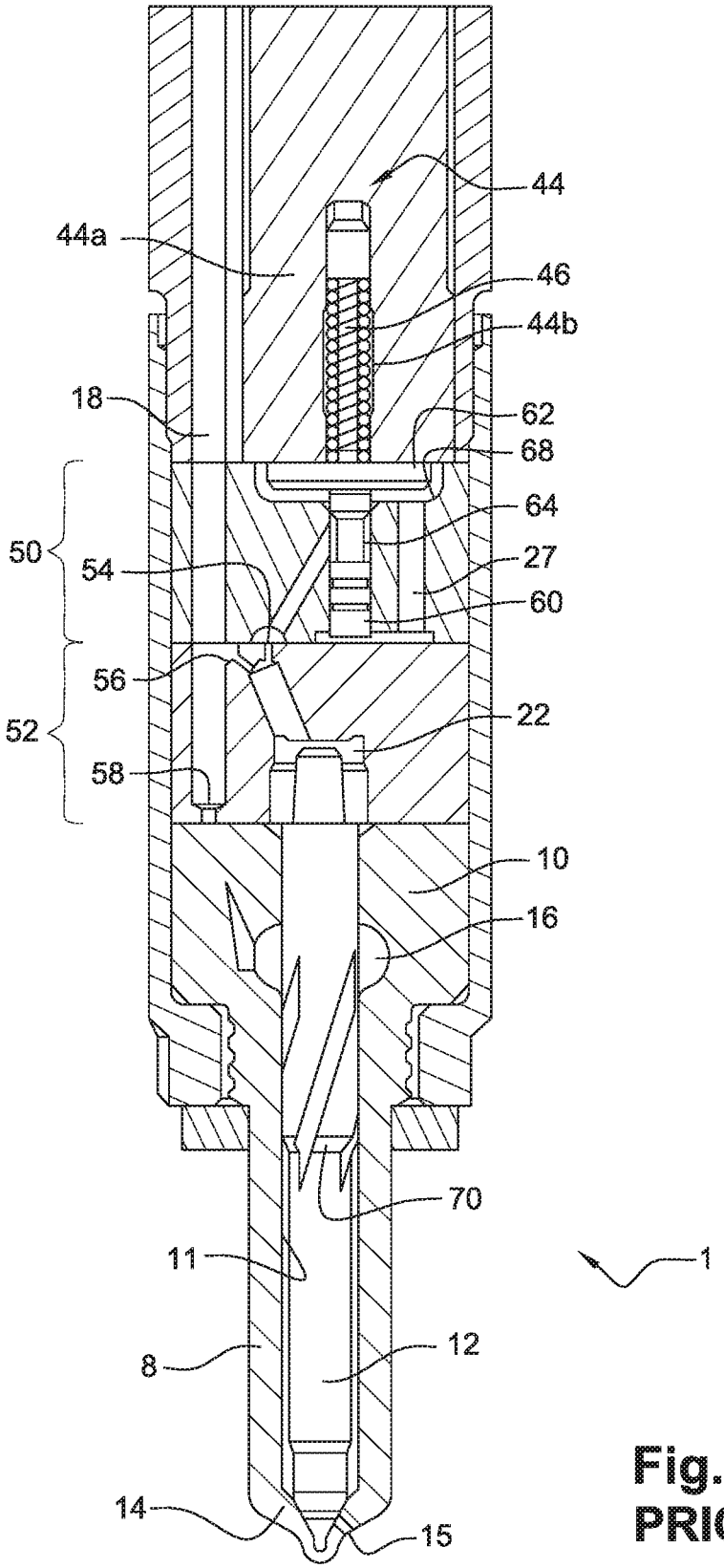
Fig. 1 PRIOR ART
FIG. 1 shows a known pressure balanced valve arrangement.
Figure 2:
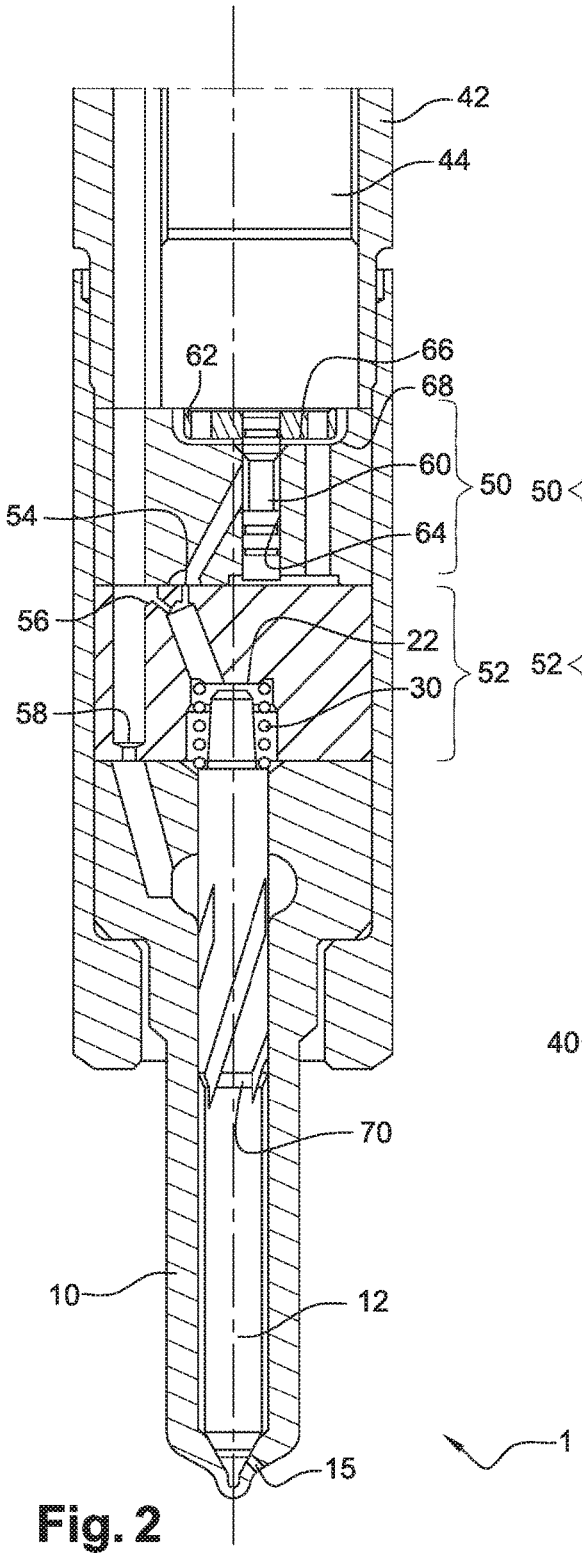
Fig. 2 PRIOR ART
FIGS. 2 to 3 show the fuel injection process for a typical injector.
Figure 3:
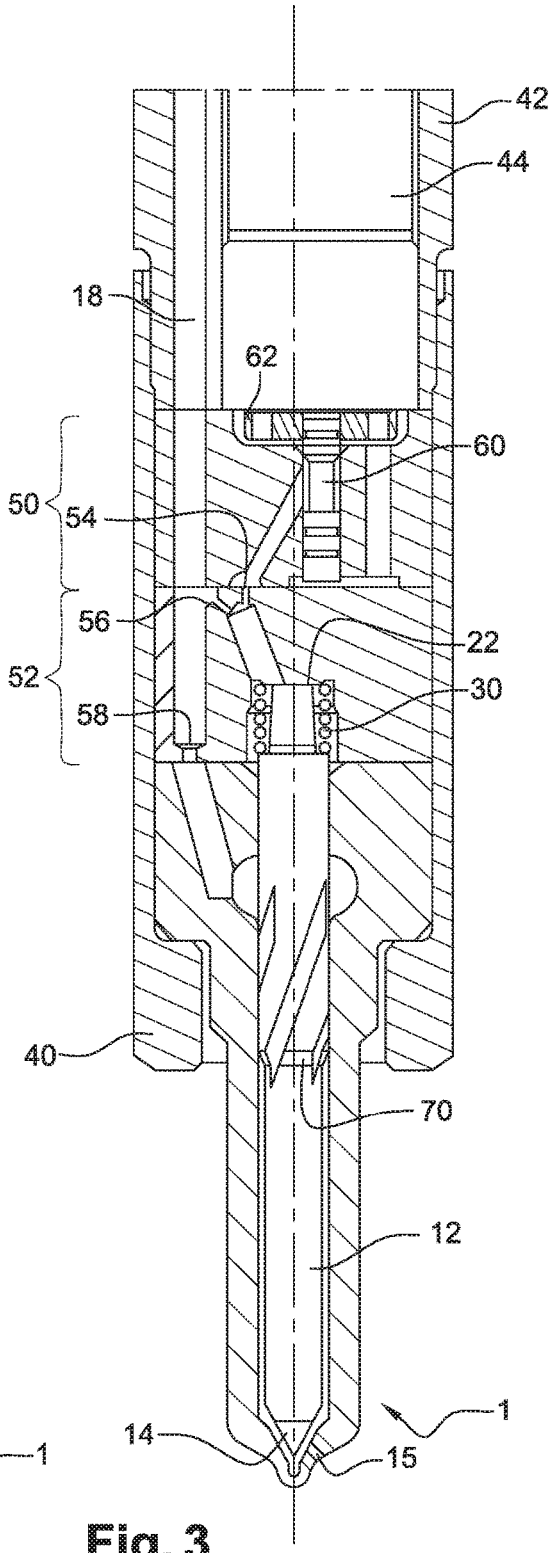
Fig. 3 PRIOR ART

A known fuel injector 1, illustrated in FIGS. 1, 2 and 3, comprises an injector/valve body 10 including a first region of relatively narrow diameter (the injector nozzle 8) and a second, enlarged region. The injector body 10 (sometimes referred to as a nozzle holder body) is provided with a bore 11 which extends through both the first (nozzle 8) and second regions, the bore terminating at a position spaced from the free end of the first region. An elongate injector needle 12 is slidable within the bore, the injector needle 12 including a tip region 14 which is arranged to engage a injector needle seat defined by the inner surface of the injector body 10 adjacent the blind end of the bore. The injector nozzle 8 of the injector body 10 is provided with one or more apertures 15 communicating with the bore, the apertures being positioned such that engagement of the tip 14 with the injector needle seat prevents fluid escaping from the injector body 10 through the apertures, and when the tip 14 is lifted from the needle seat, fluid may be delivered through the apertures.

As shown in FIG. 1, the injector needle 12 is shaped such that the region thereof which extends within the injector nozzle 8 of the injector body 10 is of smaller diameter than the bore to permit fluid to flow between the injector needle 12 and the inner surface of the injector body 10. Within the second region of the injector body 10, the injector needle 12 is of larger diameter, substantially preventing fluid flowing between the injector needle 12 and the injector body 10.

In the second region of the injector body 10, an annular gallery 16 is provided, the annular gallery 16 communicating with a fuel supply line 18 which is arranged to receive high pressure fuel from an accumulator of an associated fuel delivery system. In order to permit fuel to flow from the gallery 16 to the first region of the injector body 10, the injector needle 12 is provided with a fluted region which permits fuel to flow from the annular gallery 16 to the injector nozzle part 8 of the injector body 10, and also acts to restrict lateral movement of the injector needle 12 within the injector body 10 but not restricting axial movement thereof.

A control chamber 22 is provided within the second region of the injector body 10 at a position remote from the first region thereof, a compression spring 30 (not shown in FIG. 1, see FIGS. 2/3) being provided in the control chamber 22 for biasing the needle 12 towards the needle seat defined by the inner surface of the injector body 10 adjacent the blind end of the bore 11.

The injector in FIG. 1 further comprises an electromagnetic actuator arrangement 44 located above a valve arrangement 50. A spacer component 52 is situated underneath the valve arrangement 50 and above the needle 12. The spacer 52 integrates the control chamber 22 and three calibrated orifices (54, 56, 58) which allow operation of the injector.

The valve arrangement 50 comprises a valve stem portion 60 which carries an armature 62 at one end of the stem portion. The stem portion is slidable within a bore 64. The valve stem portion carries a number of depressurisation grooves and, at the armature end of the stem portion, there is a sealing face 66 which is engageable with a seat 68 at an end of the bore. When the sealing face is brought into contact with the seat a contact making pressure seal is made. A valve spring 46 is located above the armature and acts to urge the sealing face into engagement with its seat.

Within the spacer component 52 there is an injection supply orifice 58 (also referred to as the nozzle path orifice or NPO), a control chamber discharge orifice 54 (also referred to as the spill orifice or SPO) and a control chamber filling orifice 56 (also referred to as the inlet orifice or INO).

The control chamber 22 communicates with the high pressure fuel line 18 through the control chamber filling orifice 56.

As illustrated in FIG. 1, the solenoid actuator 44 comprises a generally cylindrical core member 44*a* including an axial blind bore 44*b*, windings (not shown in FIG. 1) being wound upon the core member 44*a* and being connected to a suitable controller, and a cylindrical yoke (not shown in FIG. 1) extending around the core member 44*a* and the windings. The faces of the core member 44*a* and yoke facing the valve arrangement 50 define pole faces.

It is noted that the valve spring 46 provides a closing force for the valve arrangement 50 and also maintains a contact pressure on the valve seat when the valve is closed.

A fuel supply line 18 supplies fuel from a high pressure fuel pump (not shown) to the injector nozzle 8 and the control chamber 22. The valve arrangement 50 is also in fluid communication with the fuel supply line 18 via the INO and SPO orifices.

When the valve arrangement 50 is closed, there is no fluid communication between the control chamber 22 and a low pressure fuel return line 27. Accordingly, the fuel pressure in the injector nozzle 8 and the control chamber 22 equalises and the spring 30 biases the injector needle 12 to a seated position in which the nozzle holes are closed.

Conversely, when the valve arrangement 50 is opened, a path is formed which places the control chamber 22 in fluid communication with the low pressure fuel return line 27 resulting in a reduction in the fuel pressure in the control chamber 22. The fuel pressure in the injector nozzle 8 is higher than the fuel pressure in the control chamber 22 and a pressure force applied to the injector needle 12 overcomes the bias of the spring 30. The injector needle 12 lifts from its seated position and opens the nozzle holes allowing fuel to be injected into the combustion chamber, as shown in FIG. 3.

On a solenoid common rail injector, the valve arrangement 50 plays an important part in controlling fuel leaks. A leak results in an energy loss and this has a direct effect on $CO_2$ emissions of a vehicle using the injector 1. In use, the fuel injector 1 will experience two forms of leaks:

(a) Dynamic leaks—these are leaks which result from the opening of the control valve arrangement 50 during injection; and (b) Static leaks—these are leaks between the control valve member 60 and the valve bore 64 when the control valve arrangement 50 is closed and the fuel injector 1 is not injecting.

Static leaks are more significant since the control valve spends more time closed than it does open. Contributing factors in static leaks include: guide clearance; guide length; increased clearance for injector and engine assembly; and increased clearance due to pressure.

The static leaks within the control valve arrangement 50 due to pressure are particularly relevant in view of the continuing trend towards higher operating pressures (for example 2200 to 3000 bar) for fuel injected into the combustion chamber. The high pressure fuel within the valve arrangement can place radial loading on the various components within the valve arrangement 50 which can cause them to distort. Distortion of these components can increase clearances within the control valve arrangement 50 which can result in an increase in static leaks.

FIGS. 2 and 3 show the injection process within the known injector of FIG. 1. Like features between FIGS. 1 and 2 are denoted by like reference numerals.

The operation of the injector will now be briefly described with reference to FIGS. 2 and 3.

In FIG. 2, the valve arrangement 50 is closed and the sealing face 66 is engaged with the seat 68. The control chamber 22 is therefore subjected to the pressure within the common rail. The high pressure fuel exerts a force on the top of the needle 12 which exceeds the pressure of fuel acting on pressure surfaces of the needle 12 (pressure surface 70 is shown in the Figure. Pressure of fuel may also act on an annular pressure surface between the maximum needle diameter and the diameter in the seat/tip region 14 of the needle 12). The needle is therefore held closed such that there is no injection through the orifices 15.

In FIG. 3, the actuator 44 is energised and lifts the armature 62 such that the valve arrangement 50 is in its open position in which the sealing face 66 lifts from its seat 68. Fuel contained within the control chamber 22 now has a flow path through the spill control orifice 54 (SPO) to a low pressure drain and fuel consequently flows from the control chamber 22. Initially the pressure exerted on the top of the needle 12 by fuel within the control chamber 22 and the injector spring 30 exceeds the pressure exerted on the pressure surface 70.

However, as soon as the pressure exerted by fuel on the pressure surface 70 exceeds the spring force and the force exerted by fuel in the control chamber 22 then the needle 12 lifts and injection of fuel through the orifices 15 commences as fuel flows from the common rail through the nozzle path orifice 58 as in FIG. 3.

To stop injection, the electromagnetic actuator 44 is de-energised and the valve spring 46 (not shown in FIG. 2) closes the valve arrangement 50. High pressure fuel passes from the supply line 18 through the control chamber filling orifice 56 (INO) and the pressure rises within the control chamber 22 until injection ceases (at which point the injector has returned to the position shown in FIG. 2).

Figure 4:
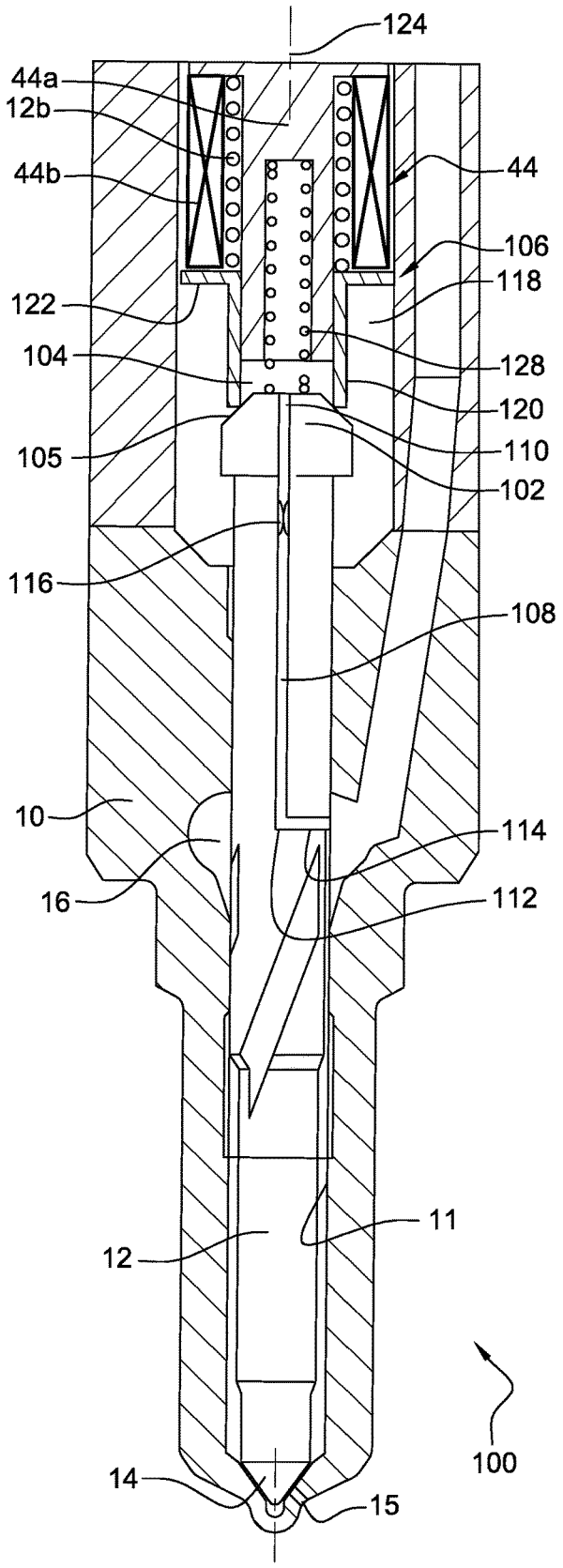
FIG. 4 shows an injector/valve arrangement according to an embodiment of the present invention.

Turning to FIG. 4, a fuel injector 100 according to an embodiment of the invention is shown. Like features within the figures are denoted with like reference numerals.

As in FIGS. 1, 2 and 3 the injector comprises an injector body 10 defining a bore 11 within which an injector needle 12 is slidable. An annular gallery 16 within the injector body 10 is in fluid communication with a high pressure fuel supply line 18 which is arranged to receive high pressure fuel from an accumulator volume (not shown in FIG. 4).

The end 102 of the injector needle 12 remote from the tip 14 is generally frusto-conical in shape. A control chamber 104 is defined in part by the surface of the frusto-conical end 102 of the injector needle and by an armature member 106 located between the injector needle 12 and solenoid actuator 44. The control chamber 104 therefore is located above the end 102 of the needle 12. As shown in FIG. 4 the armature member 106 has engaged with an armature seat 105 on the surface of the frusto-conical end 102 of the injector needle.

The injector needle 12 of FIG. 4 comprises an axial drilling 108, a first end 110 of which opens into the control chamber 104. A second end 112 of the drilling 108 is in fluid communication with the annular gallery 16 via one or more transverse drillings 114 (only one of which is shown in FIG. 4 for clarity).

A control chamber filling orifice 116 (also referred to as the inlet orifice or INO) is located within the axial drilling 108. It is noted that in the event that there is a single transverse drilling 114 then the orifice 116 could be located in the drilling 114.

The pressure of fluid within the control chamber may be controlled by energising/de-energising the actuator arrangement 44. Upon energisation of the solenoid actuator 44 the armature member 106 is lifted such that the armature member 106 disengages from the armature seat 105 and the control chamber 104 is brought into fluid communication with a low pressure volume/low pressure drain 118. The clearance that opens up between the armature member 106 and the armature seat 105 when the actuator 44 is energised performs the function of the control chamber discharge orifice 54 (spill orifice or SPO) in FIGS. 1, 2 and 3.

The armature member 106 comprises a cylindrical portion 120, the internal surfaces of which define in part the control chamber 104, and an armature projection portion 122 which projects substantially perpendicular to the long axis of the cylindrical portion (and also substantially perpendicular to the long axis 124 of the fuel injector).

An armature spring 126 within the bore of the solenoid 44 returns the armature member 106 into engagement with the armature seat 105 upon de-energisation of the actuator 44. A further compression spring 128 located within the bore of the solenoid biases the injector needle 12 towards its valve seat. In the arrangement of FIG. 4 the armature spring 126 and compression spring 128 are disposed concentrically relative to one another.

The operation of the fuel injector according to an embodiment of the present invention is now described with reference to FIGS. 4 to 7.

In FIG. 4 the injector is closed and the injector needle is engaged with the valve seat such that the fuel cannot flow through the apertures 15 in the injector body 10. The pressure of fuel is substantially the same at the top of the needle 12 and at the bottom of the needle 12. The surface area of the top of the needle is larger than the bottom of the needle and a force is generated towards the tip 14. This force acts with the force generated by the armature spring 126 and compression spring 128 to keep the injector needle 12 on its valve seat.

Figure 5:
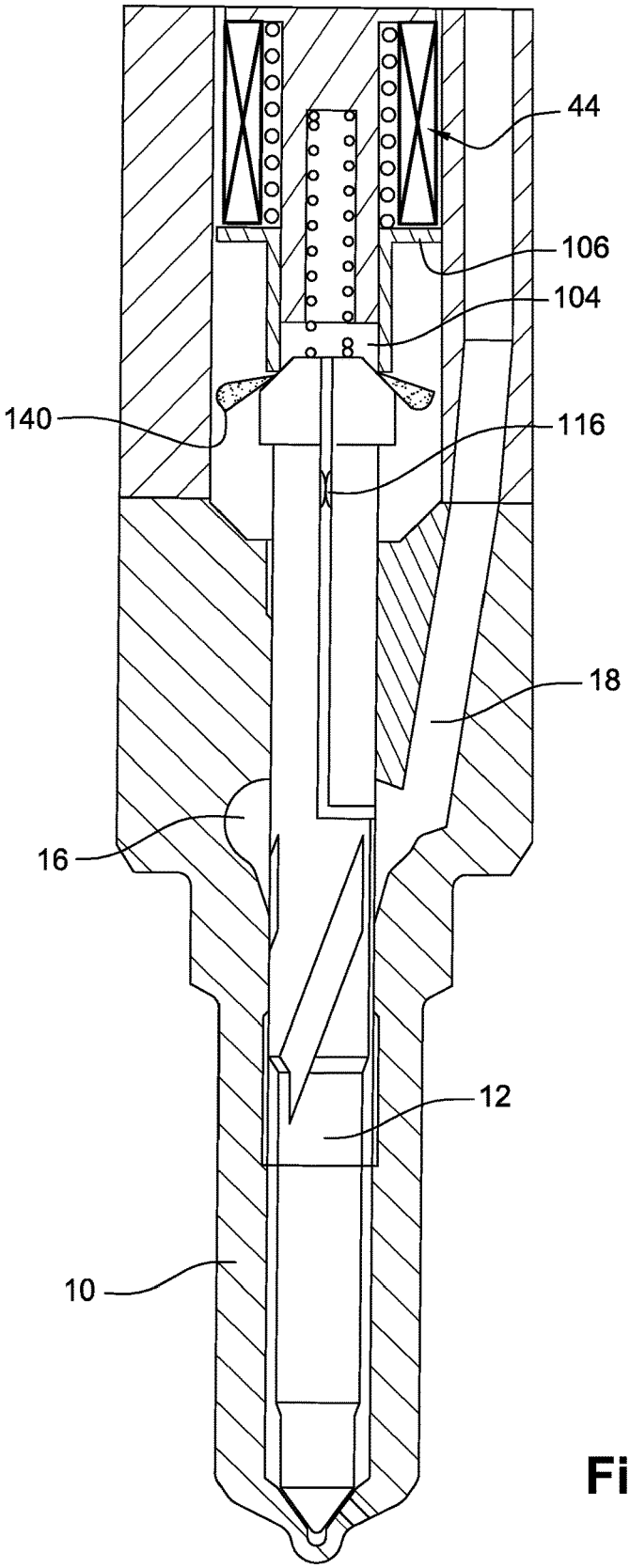
FIGS. 5 to 7 show the fuel injection process for the injector of FIG. 4.

In FIG. 5, an injector open command has been sent from a control system (not shown) to the solenoid actuator 44. As the solenoid actuator is energised the armature member 106 lifts from the armature seat 105 such that a fluid path 140 is opened between the control chamber 104 and the low pressure region 118. High pressure fluid within the control chamber 104 begins to drain to the low pressure region. High pressure fuel within the supply line 18 and gallery 16 is drawn through the axial drilling 108 into the control chamber 104. The flow of high pressure fuel is, however, limited by the control chamber filling orifice 116.

The magnetic force exerted by the solenoid actuator 44 on the armature member 106 is greater than the armature spring 126 force and as a consequence the armature member is lifted from its seat on the injector needle 12. The pressure within the control chamber 104, following the lifting of the armature member 106, is lower than the pressure on the bottom of the needle. An upward force is generated on the injector needle that exceeds the compression spring force 128 and so the needle also begins to lift.

Figure 6:
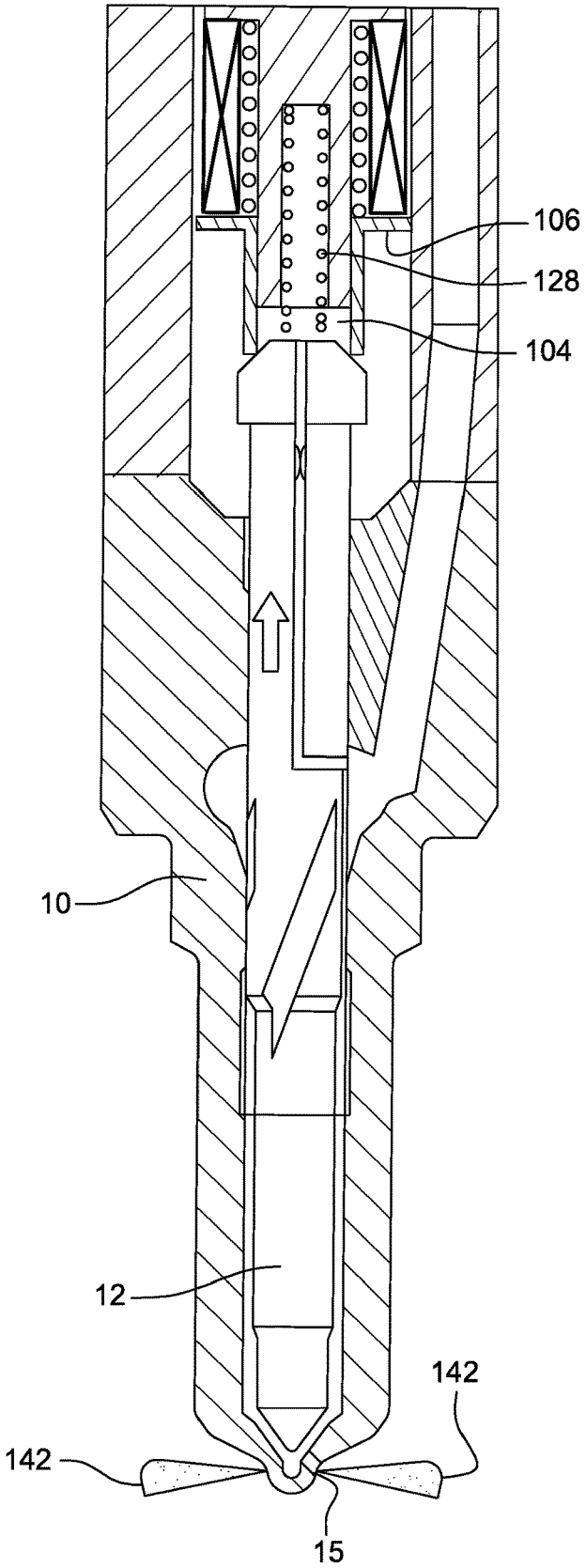

FIG. 6 shows the continued opening phase of the injector needle 12 and the commencement of injection. As the injector needle 12 lifts from its valve seat fuel may enter the region in the vicinity of the lower tip 14 of the injector needle and pass through the apertures 15 such that injection 142 into a combustion volume (not shown) occurs.

The injector needle will continue to rise until it comes to seat again on the armature member 106. As the injector needle seats against the armature member the pressure within the control chamber begins to rise again. When the pressure within the control chamber 104 rises to a sufficient level the fuel pressure at the top and bottom of the needle reaches an equilibrium such that the needle spring 128 and the pressure forces pushes the injector needle downwards and the injector needle 12 disengages from the armature member 106.

As the injector needle moves downwards the control chamber is again exposed to the low pressure region and fuel moves from the control chamber towards the low pressure drain. As the pressure drops in the control chamber again, the pressure imbalance between the bottom and top of the injector needle again pushes the injector needle upwards. The injector needle then enters an "equilibrium state" in which the injector needle "floats" between a position where it is seated on the armature member and a position where it has moved away from the armature seat. This "floating" behaviour continues until the solenoid actuator is de-energised.

Figure 7:
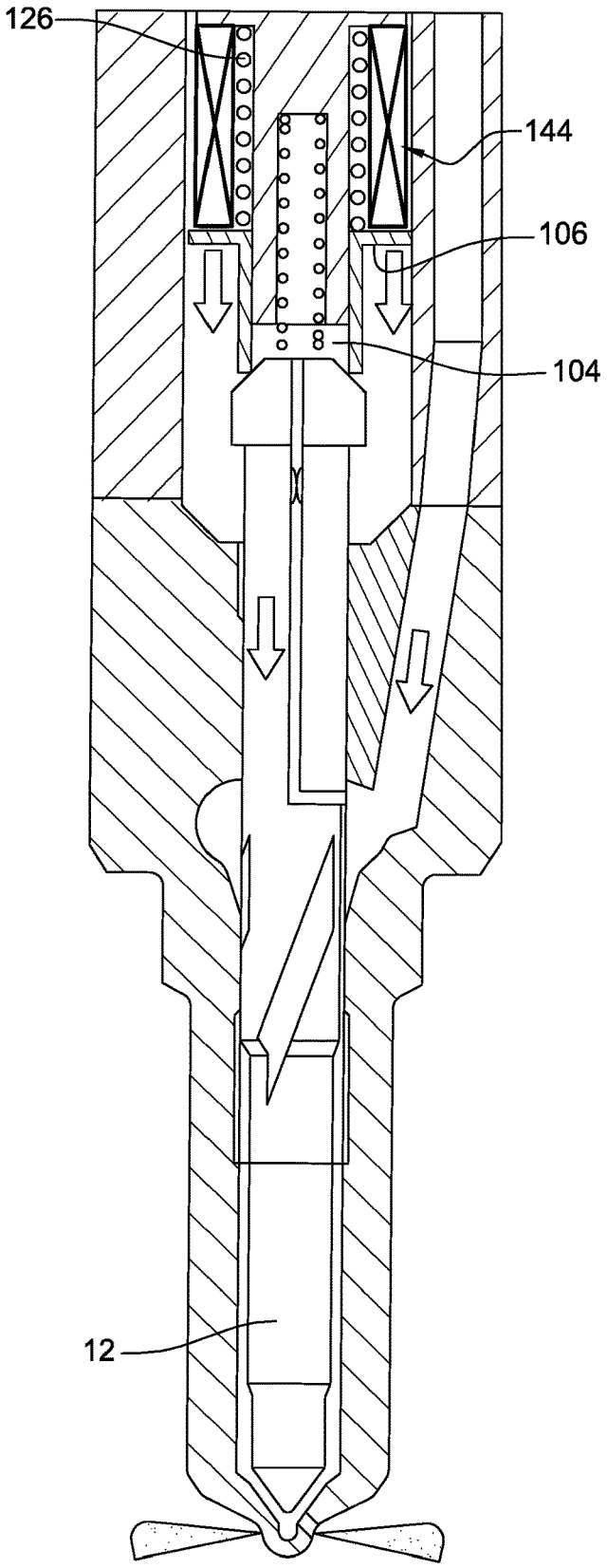

FIG. 7 shows the closure of the injector needle. In FIG. 7 the solenoid actuator 44 is de-energised such that the armature member 106 is no longer magnetically attracted towards the actuator. The actuator spring member 126 then acts to bring the armature member 106 into engagement with the armature seat 105. The control chamber 104 then begins to fill due to fuel feeding in via the axial drilling/orifice 108.

As the control chamber 104 begins to pressurise the pressure difference between the top and the bottom of the needle 12 decreases until such time as the injector needle 12 and armature member 106 are able to move towards the valve seat under the action of the actuator spring member 126 and the valve spring 128. As the injector needle closes the apertures 15 are closed off and the injection cycle comes to an end. The pressure within the control chamber 104 and annular gallery 16 return to the pressure within the high pressure drilling.

Figure 9:
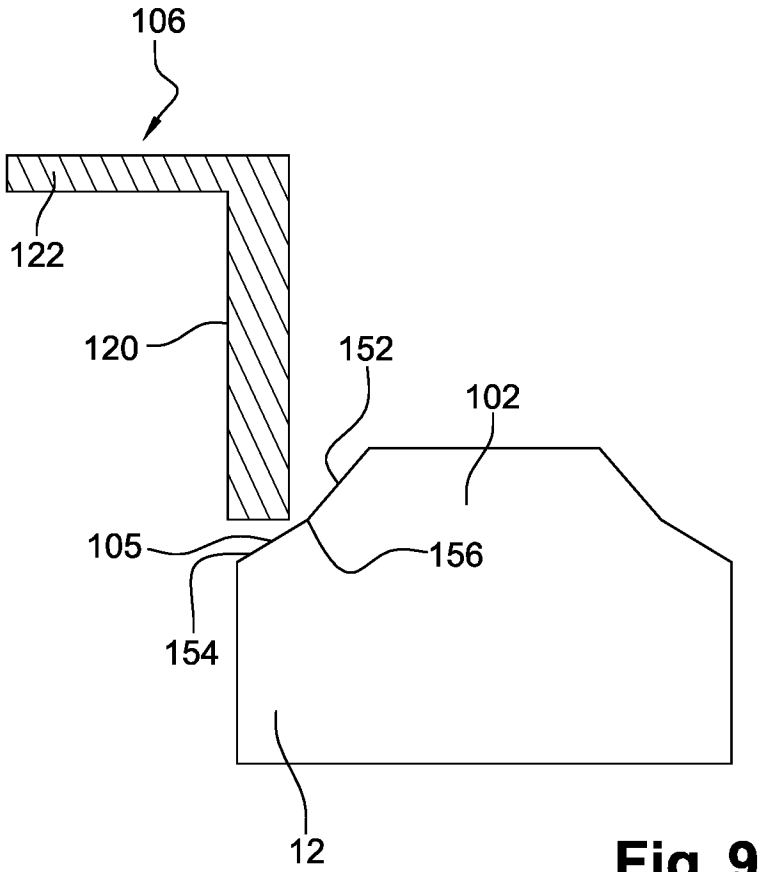
FIGS. 8 and 9 show two examples of an injector arrangement in accordance with embodiments of the present invention.
Figure 8:
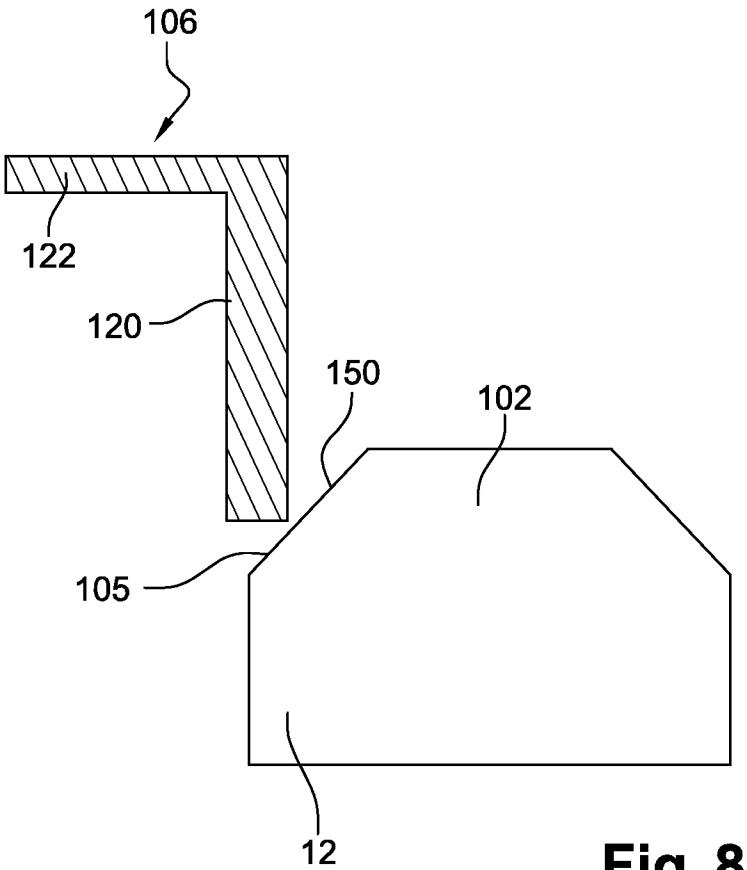

FIGS. 8 and 9 illustrate how the profile of the frusto-conical end section 102 of the needle 12 may be varied.

In FIG. 8 the frusto-conical section has a single profile 150. FIG. 9 shows an alternative arrangement in which the end 102 of the injector needle 12 comprises two different profiles 152, 154. Providing a injector needle end profile with varying profiles allows the control chamber 104 to be drained at different rates depending on the lift of the armature member 106 relative to the armature seat 105.

In the example of FIG. 9, an initial, "pilot", injection command may be sent to the solenoid actuator 44 which lifts the armature member 106 away from the armature seat 105 by a relatively small amount. If a main injection command is sent to the actuator 44 however then the armature member may move further from its seat. At a certain point the armature member will move higher than the point 156 where the profile of the end 102 of the needle tip changes. As the injector needle passes this point then a greater volume of fuel may spill to the low pressure drain. In this manner a relatively greater amount of fuel may be spilled to the low pressure drain if the solenoid actuator is energised to a sufficient level. This in turn enables a larger amount of fuel to be injected via the nozzle orifices.

Figure 10:
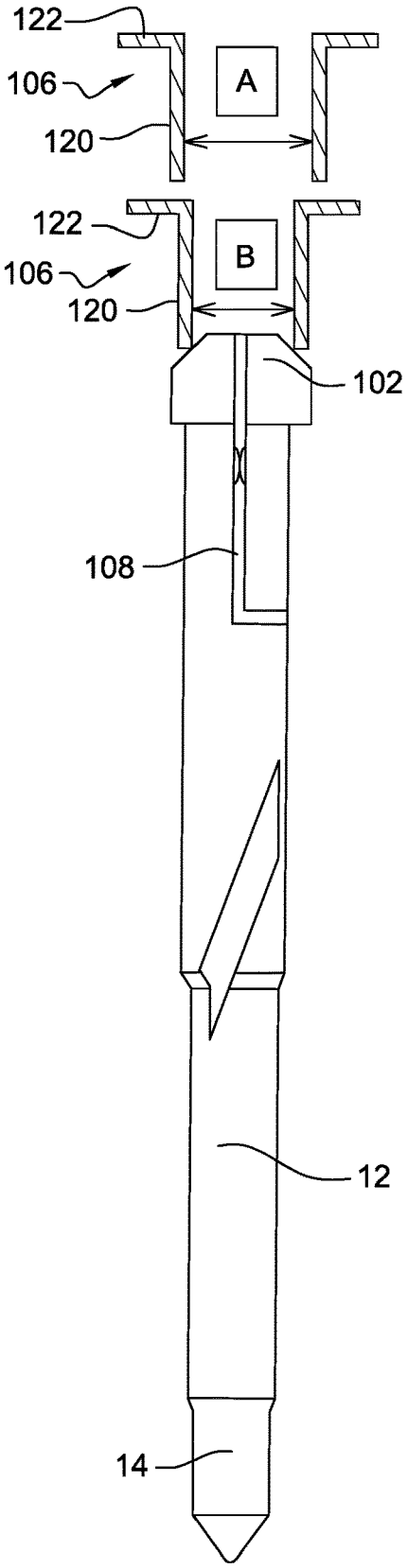
FIG. 10 shows further examples of injector arrangements in accordance with embodiments of the present invention.

FIG. 10 shows alternative embodiments of the present invention in which the size of the control chamber 104 is varied by increasing the cross sectional area of the cylindrical portion 120 of the armature member 106. FIG. 10 shows two different arrangements (labelled "A" and "B") in which the cross-sectional area of one arrangement is larger than the other (A>B).

In arrangement A the pressure at the top of the injector needle 12 when the control chamber 104 is filled and the armature member 106 is seated on the armature seat 105 will be higher than in arrangement B. This will, in turn, impact upon the opening speed of the injector needle (A is slower than B) due to the increased pressure of fuel at the top of the injector needle.

Figure 11:
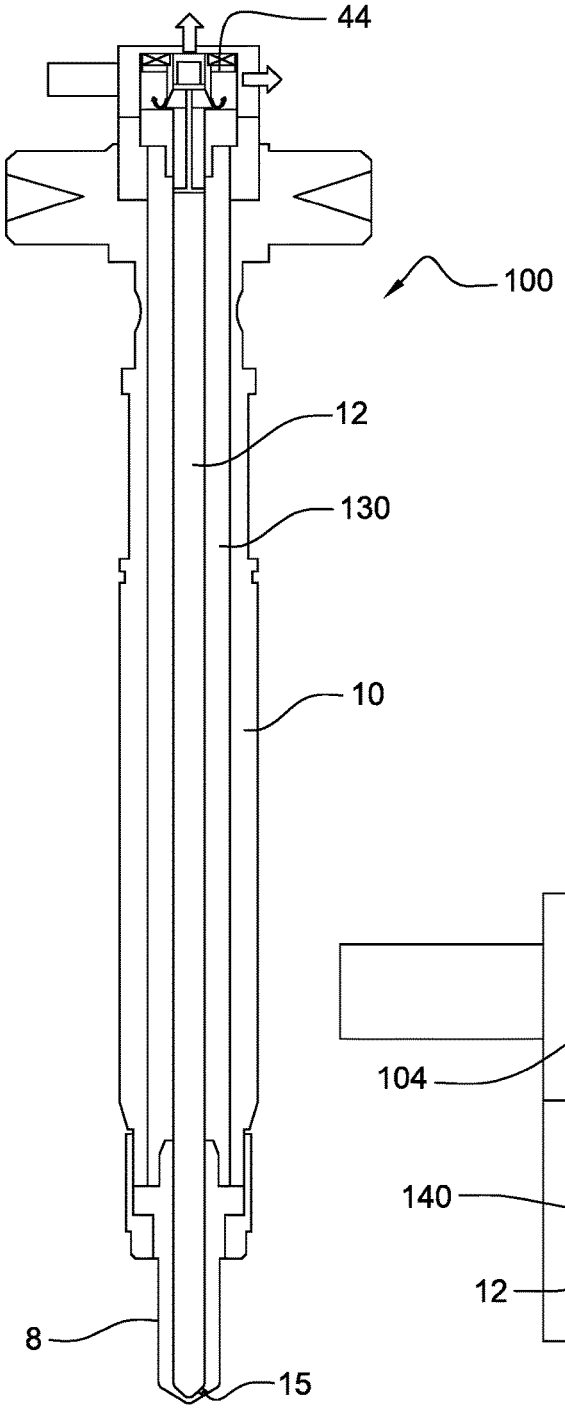
FIG. 11 is an axial section of another embodiment of an injection as per the invention.
Figure 12:
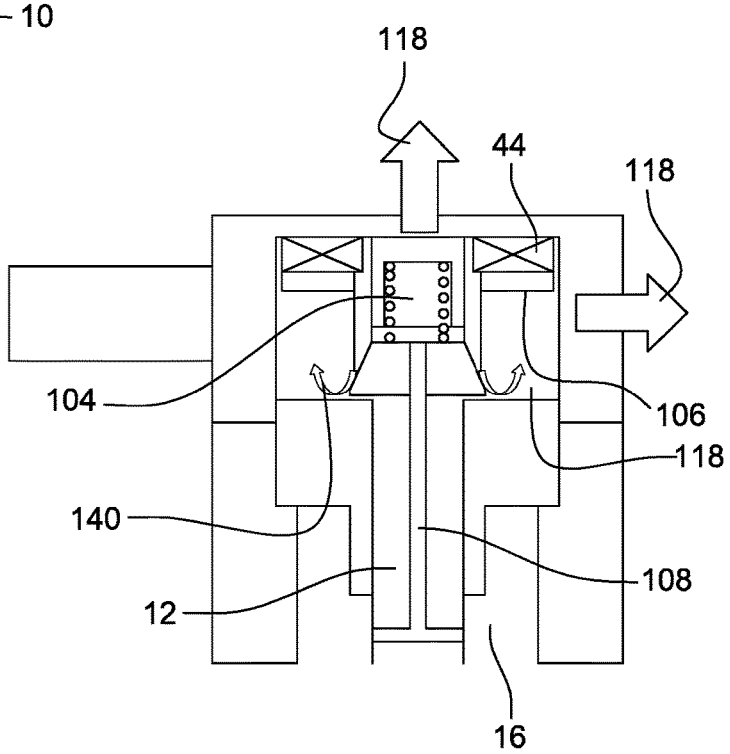
FIG. 12 is a detail of the injector of FIG. 11.

FIGS. 11 and 12 show another embodiment of an injector 100 as per the invention. Reference numbers have been kept from previously described embodiments even if the features have specific characteristics. As visible on FIG. 11, the actuator arrangement 44 is arranged on the very top of the injector 100, at the opposite end to the nozzle 8 and the apertures 15. Said actuator arrangement 44 has a similar structure as in previous embodiments with a relatively flat solenoid cooperating with the armature member 106 in order to control the pressure within the control chamber 104. As visible the control chamber 104 is defined by the top of the needle 12 and the cylindrical inside volume of the armature member 106.

This top mounted arrangement enables to the solenoid arrangement 44 to directly control the displacements of the needle 12 in order to inject, or not, fuel through the apertures 15 of the nozzle 8. Such top mounted arrangement enables to reserve, inside the injector body 10, a large reservoir 130 through which the needle 12 axially extends. Said reservoir 130 could hold over to 10 $cm^3$.

In operation, the high pressure fuel entirely fills the reservoir 130 enabling further flexibility on the structure of the fuel injection equipment. For instance, each injector 100 of the equipment being provided with its own high pressure reservoir 130, the equipment may be of rail-less type, where the high pressure reservoir, instead of being concentrated in a common rail is distributed over the injectors.

It will be understood that the embodiments described above are given by way of example only and are not intended to limit the invention, the scope of which is defined in the appended claims. It will also be understood that the embodiments described may be used individually or in combination.

The invention claimed is:

1. A fuel injector for use in an internal combustion engine, the fuel injector comprising:

an injector body comprising a bore;

an injector needle located within the bore and engageable with a needle seat to control fuel injection through an injector outlet, the injector needle comprising an armature seat;

an armature member which is hollow, thereby defining an internal surface of the armature member, the armature member being engageable with the armature seat on the injector needle, the injector needle in part and the internal surface of the armature member in part defining a control chamber;

an actuator arrangement arranged to control fuel pressure within the control chamber such that fuel pressure variations within the control chamber controls movement of the injector needle relative to the needle seat;

wherein the actuator arrangement is arranged to be capable of moving the armature member from a seated position in which it engages the armature seat to an unseated position in which the armature member has moved relative to the armature seat in order to bring the control chamber into fluid communication with a low pressure drain which circumferentially surrounds the control chamber.

2. A fuel injector as claimed in claim 1, wherein the bore within the injector body comprises an annular gallery.

3. A fuel injector as claimed in claim 2, wherein the gallery is in fluid communication with an accumulator volume via a high pressure drilling.

4. A fuel injector as claimed in claim 1, wherein the injector needle comprises an axial drilling.

5. A fuel injector as claimed in claim 4, wherein the axial drilling is in fluid communication with a source of high pressure fuel at a first end and in fluid communication with the control chamber at a second end.

6. A fuel injector as claimed in claim 5, wherein the axial drilling comprises a control chamber filling orifice to control the flow of fuel from the source of high pressure fuel into the control chamber.

7. A fuel injector as claimed in claim 4 wherein the axial drilling is in fluid communication with an annular gallery within the bore of the injector body, the gallery being in fluid communication with an accumulator volume via a high pressure drilling.

8. A fuel injector as claimed in claim 1, further comprises an armature spring member arranged to bias the armature member towards the armature seat.

9. A fuel injector as claimed in claim 1, further comprising an injector needle spring member arranged to bias the injector needle towards the needle seat.

10. A fuel injector as claimed in claim 1, wherein the armature seat is located at one end of the injector needle.

11. A fuel injector as claimed in claim 10, wherein the end of the injector needle comprising the armature seat is substantially frustoconical defining an injector needle end profile, the armature seat being located on the end profile.

12. A fuel injector as claimed in claim 11, wherein the end of the injector needle comprising the armature seat comprises more than one end profile.

13. A fuel injector as claimed in claim 10, wherein a second end of the injector needle is arranged to engage the needle seat.

14. A fuel injector as claimed in claim 13, wherein the actuator arrangement is arranged to move the armature member from the seated position in which it engages the armature seat to a pilot injection position and a main injection position, the rate of flow of fuel from the control chamber to the low pressure drain being greater in the main injection position than the pilot injection position.

15. A fuel injector as set in claim 1, wherein the actuator arrangement is arranged on an extremity of the fuel injector opposite to the injector outlet.

16. A fuel injector as in claim 1, wherein the actuator arrangement is arranged to apply a magnetic force on the armature member to move the armature member to the unseated position.

17. A fuel injector as in claim 1, wherein engagement of the armature with the armature seat blocks fluid communication between the control chamber and the low pressure drain.

* * * * *